US009839292B2

(12) United States Patent
Miller

(10) Patent No.: US 9,839,292 B2
(45) Date of Patent: Dec. 12, 2017

(54) ROTATING AND NON-ROTATING RECLINING CHAIRS W/TILTING MECHANISMS

(71) Applicant: John Hart Miller, Aurora, CO (US)

(72) Inventor: John Hart Miller, Aurora, CO (US)

( * ) Notice: Subject to any disclaimer, the term of this patent is extended or adjusted under 35 U.S.C. 154(b) by 41 days.

(21) Appl. No.: 13/999,948

(22) Filed: Apr. 8, 2014

(65) Prior Publication Data

US 2015/0282621 A1 Oct. 8, 2015

(51) Int. Cl.

| | |
|---|---|
| ***A47C 1/032*** | (2006.01) |
| ***A47C 1/024*** | (2006.01) |
| ***A47C 1/034*** | (2006.01) |
| ***A47C 7/50*** | (2006.01) |

(52) U.S. Cl.

CPC ..... *A47C 1/03255* (2013.01); *A47C 1/024* (2013.01); *A47C 1/0242* (2013.01); *A47C 1/0244* (2013.01); *A47C 1/0342* (2013.01); *A47C 7/506* (2013.01)

(58) Field of Classification Search

CPC ..... A47C 7/54; A47C 1/03255
USPC ..... 297/215.15
See application file for complete search history.

(56) References Cited

U.S. PATENT DOCUMENTS 3,926,472 A * 12/1975 Evans ..... A47C 1/0345 297/259.2
4,372,606 A * 2/1983 Faull ..... A47C 3/025 297/265.1
4,477,118 A * 10/1984 Ruble ..... A47C 1/0355 297/259.2
4,652,050 A 3/1987 Stevens
5,286,088 A * 2/1994 Taylor ..... A47C 1/03255 297/300.1
5,649,740 A 7/1997 Hodgdon
5,890,691 A * 4/1999 Payne ..... B62J 1/02 248/289.31
6,022,071 A 2/2000 Smith
6,033,013 A * 3/2000 Lee ..... A47C 7/54 297/115
6,106,058 A * 8/2000 Sur ..... A47C 7/54 297/188.14
6,540,291 B2 4/2003 Hoffman et al.
6,659,556 B2 12/2003 Pellerin
7,311,359 B2 12/2007 Smith
7,396,080 B2 7/2008 Suhr et al.
7,461,897 B2 12/2008 Kruse et al.
7,575,279 B2 8/2009 Robertson
7,775,944 B1 8/2010 Shultz
7,857,390 B2 12/2010 Schmitz et al.
7,938,489 B2 5/2011 Nazari
(Continued)

*Primary Examiner* — Timothy J Brindley

(57) ABSTRACT

A reclining and declining chair, preferably one that rotates with respect to its base, having a chair seat frame or plate and having a vertical or generally vertical member that extends beneath to support is reclined and declined by tilting at least an upper portion of the vertical or generally vertical support. Optionally the chair can also have a reclining backrest and a leg/foot rest that can be raised and lowered. The tilting, reclining, declining and raising and lowering motions are accomplished by drive mechanisms that can be manually powered, electrically powered, fluid driven, etc. with operator controls allowing increased range and ease of reclining, declining plus other desirable advantages with these types of chairs.

13 Claims, 6 Drawing Sheets

(56) References Cited

U.S. PATENT DOCUMENTS 9,022,473 B2 * 5/2015 Crum ..... A47C 1/032 297/259.2
2002/0043846 A1 4/2002 Brauning
2004/0195883 A1 * 10/2004 Vrijlandt ..... A47C 1/03255 297/302.4
2006/0097558 A1 * 5/2006 Aubert ..... A47C 1/03238 297/344.26
2006/0208548 A1 * 9/2006 Liviero ..... A47C 1/03255 297/303.5
2007/0001499 A1 1/2007 Smith
2007/0035164 A1 * 2/2007 North ..... A47C 1/0242 297/217.1
2007/0222265 A1 9/2007 Machael et al.
2007/0246984 A1 * 10/2007 Saez ..... A47C 1/032 297/300.2
2009/0152921 A1 6/2009 Johnson et al.
2010/0194156 A1 * 8/2010 Kim ..... B62J 1/08 297/215.15
2010/0320809 A1 * 12/2010 Roleder ..... A47C 1/0342 297/69
2011/0031793 A1 2/2011 Machael et al.
2011/0156456 A1 * 6/2011 Hung ..... A47C 7/543 297/188.19
2011/0221245 A1 * 9/2011 Kim ..... B62K 19/36 297/215.15
2011/0254329 A1 * 10/2011 Kim ..... B62J 1/08 297/215.15
2012/0175928 A1 7/2012 Eber
2012/0248831 A1 10/2012 Garland
2012/0286557 A1 11/2012 Hoffman et al.
2013/0249256 A1 9/2013 Payne, Jr. et al.
2014/0265460 A1 * 9/2014 Voigt ..... A47B 83/02 297/61
2014/0319883 A1 * 10/2014 Shively ..... A47C 4/28 297/35
2015/0239516 A1 * 8/2015 Nelson ..... B62J 1/08 297/215.15
2016/0088942 A1 * 3/2016 Murphy ..... A47C 1/0242 297/311

* cited by examiner

ROTATING AND NON-ROTATING RECLINING CHAIRS W/TILTING MECHANISMS

This application claims the benefit of provisional application No. 61/853,824 filed Apr. 12, 2013. The invention involves recliner chairs, preferably rotating or swiveling types, and particularly having new, compact and easy to use mechanisms for achieving the reclining and/or declining feature, and optional features that enhance the functionality and overall pleasure and convenience while enjoying the chairs.

BACKGROUND

Most reclining chairs have a mechanism that comprises a plurality of pivoting link members on each side of the chair, or one or more telescoping tubes, that extend and retract to recline and decline and to raise and lower the leg rest. These chairs also have a square or rectangular shape or base that extends to the floor. Recently, other mechanisms for reclining the chair back have been introduced that permits the chair to rest on a single round rod, pipe or other vertical support including a generally vertical support on each side of the chair, the former usually nesting in a lower vertical pipe or mount attached at or near its bottom end to a low profile round base. These latter mechanisms allow the reclining chair, comprising a seat, two armrests and a back, to rotate, swivel horizontally with respect to the base. These mechanisms offer new chair designs that look very different than conventional reclining chairs, but have limitations including limited reclining range, having to unlock a reclining mechanism by turning a wheel, knob or lever and then having to relock the mechanism by turning the wheel, knob or lever in the opposite direction, difficulty of causing recline and decline and usually a lack of an attached lifting leg/foot rest. Because of one or more of these limitations, these chairs are usually offered with a matching footstool, objectionable to some people, and are often not preferred over the more conventional reclining chairs having greater ease and range of recline and a lifting/lowering foot/leg rest that is part of the reclining chair.

SUMMARY OF THE INVENTION

The invention includes a reclining and/or declining chair comprising a chair seat frame and/or a seat plate and/or a seat supported by one or more vertical or generally vertical member(s), when the chair is in a normal sitting position, and having one or more first mechanisms for changing the angle that the one or more vertical or generally vertical support member(s) make with vertical, tilting, to cause a reclining or declining of the chair, the chair also comprising a padded seat, a base, optional armrests, one or more optional storage compartments and a back rest. The reclining and/or declining chair can also have a leg rest with or without a mechanism to raise and lower the leg rest. Preferably, but not necessarily, the reclining and/or declining chair can rotate or swivel up to 360 degrees, more of less, because the vertical or generally vertical support for the seat plate or frame can rotate or swivel with respect to the base of the chair, with the uniqueness residing in the simplicity of the reclining mechanism and the resulting lower manufacturing cost, appearance and use benefits. By generally vertical is meant within about 5-20 degrees from vertical, preferably within 10 degrees or even within 5 degrees from vertical. The vertical or generally vertical one or more support(s) typically have a reclining range of up to 45 degrees or less from a normal sitting position, more typically up to about 35 degrees and even more typically an angle of up to about 10, or 15, or about 15 to about 25 degrees in any increments thereof. The vertical or generally vertical one or more support(s) typically have a declining range of any angle up to about 15 degrees from the normal sitting position, i.e. with the seat being about horizontal, more typically any angle up to about 12 or 10 or 8 or 5 or 4 degrees. When the word "chair" is used in the description of the invention it means a combination of a seat, a back rest, a base and a declining and/or reclining mechanism, and optionally can have other features including a leg rest and/or a foot rest, armrests and one or more storage compartments and one or more article holders.

The invention involves a reclining chair that is supported by a vertical or generally vertical member, optionally a chair that pivots or rotates around its base, and having one or more new and improved mechanisms for changing the angle the vertical or generally vertical member makes with vertical to cause a reclining or declining of the chair, and optionally one or more mechanisms for raising a leg and/or foot rest. Further, the chair can optionally have one or two hinged arm rests with a chamber below the armrest for storing books, magazines, newspapers, or other items, and optionally a removable, pivoting tray, like or similar to those used on some passenger airplane seats. The arm rest(s) can also optionally have one or more recessed cup holders, controls for the recliner mechanism and/or leg rest mechanism, light switch, and one or more recesses to hold remotes for video and/or audio devices including a TV, stereo, tuner, DVD and/or CD player and the like.

The chair of the invention preferably both reclines, returns and slightly declines to permit easier ingress and egress, all done with an electric, mechanical, manual, air, or hydraulic driven actuator mechanism selected from a group of mechanisms, many of which are described below. The chair itself can be of any of many shapes as desired, as can the base that sits on a reasonably flat surface, usually on a floor, and supports the chair. The chair is comprised of a seat and backrest, and optionally, one or more arm rests, a leg rest and/or a footrest. The recliner is comprised of a chair, a base, an upper support, a reclining mechanism and optionally a lower support, a leg and/or footrest and a declining mechanism, the latter that can be incorporated in the reclining mechanism. Optionally, the recliner can optionally have one or more arm rests, preferably hinged, a leg rest and/or footrest raising and lowering mechanism, and one or more accessories including one or more storage compartments for magazines, books, retractable tray and other things, cup holders, remote control holder(s), cell phone holders, built in controls, retractable tray(s), and reading lights. Preferably, the backrest also reclines and returns to a sitting or exiting position and more preferably the reclining and returning is accomplished with a mechanism controlled by the user.

The invention also involves mechanisms for attaching to a chair, preferably to a frame or plate attached to the seat and/or arm(s) of the chair comprised of a seat, a back and, a base, and optionally one or two arms, the mechanism also attached to the base of the chair via a linear support, the base of the chair comprising a low profile stabilizing base and a support for the mechanism(s), preferably a support that allows the chair to rotate horizontally. The mechanisms, which can be manual but preferably are electrically powered, operate to change the angle from vertical of an upper linear support member that is attached one or more a frame or plate or plate like member, the changing of the angle of the upper linear support acting to recline or incline, or optionally even decline, the chair back and seat, and optional arms.

The mechanisms comprise an upper support, preferably linear and including a pipe, cylinder, box channel, rod and other shapes for attaching to a rigid frame or rigid plate or plate like member that attaches to the chair, preferably to a frame or plate attached to underneath of the chair seat and/or arm rests or arm rest support(s) of the chair. While the frame can be mounted to the backrest of the chair, but that is normally more expensive and not preferred. The upper linear support can be of any reasonable shape and/or cross section shape, but preferably is a straight or bent cylinder, rod, beam, box channel or pipe, even with one end mashed to form an oval or racetrack shape. As the upper linear support axis is tilted to various angles from vertical the chair reclines and as the upper linear support axis is tilted to various angles in the opposite direction the chair reverses to a normal upright position, or optionally even to a declining position to enable the sitter to more easily leave and enter the reclined chair. The upper linear support attaches on its lower end to another member of the mechanism, this other member differing depending on the type of the rest of the mechanism. While a linear upper support is preferred, the upper support need not be linear, but can be curved, angled or spiraled. In the invention the chair seat is reclined and declined by changing the angle of the generally vertical support supporting the chair seat, seat plate and/or chair seat frame makes with the vertical. The generally vertical support can be in one piece that extends to a holder mounted in or on the base or can be attached to another vertical or generally vertical support, a lower support, in a manner that allows the upper generally vertical support to change its angle with respect to vertical. The generally vertical support, whether in one or more pieces, is supported by a holder, in or on the base, such that the generally vertical support can rotate clockwise and counterclockwise up to 360 degrees or more.

One preferred feature of the mechanisms of the invention allows the upper vertical or generally vertical linear support to tilt away from vertical in one direction and back, or optionally in two opposite directions from vertical by causing the upper linear support to pivot around a pin or bolt supported by, or to pivot on a rounded upper surface of, the lower vertical support. The power and control of the pivot direction and amount is preferably a device like a linear actuator powered either electrically, directly or indirectly, or can be manual, e.g. with a rack and pinon and manual drive wheel, lever, etc. By indirectly is meant where electrical current is used to drive a motor to a gear drive, compressor, hydraulic pump or other device that will provide power to a linear actuator or device that will push and pull the chair support to cause at least an upper portion of the chair support to tilt in various desired angles, preferably in the same or nearly the same plane.

Other mechanisms for tilting the vertical or generally vertical support, or an upper portion thereof, such as containing two or more wheels or guides that support the upper vertical or generally vertical support in the desired path, by rolling or sliding against a curved surface or guide while tilting the vertical or generally vertical support, or an upper portion thereof, with respect to the vertical are included in this invention with some preferred embodiments thereof shown and described herein. Other optional features, e.g. manual or otherwise powered backrest, leg/foot rests, hinged arm rests, storage compartments, cup, remote (chair, TV, etc.) holders, lamps, and optional fixed controls in arm rests, and various trays are also included with some embodiments shown herein.

Those skilled in this art will appreciate that the pivots, hinges between parts or other components can take a variety of configurations, such as pivot pins, rivets, bolt and nut combinations, and the like, any of which may be suitable for use with the present invention. Also, the shapes and configurations of the links or parts themselves may vary, as will be understood by those skilled in this art, so long as they perform the same function in substantially the same manner. Further, some parts may be omitted entirely in some embodiments, and additional parts may be included in some embodiments. Various chairs in which the reclining and/or declining action is exclusively achieved by mechanisms entirely within a seat support plate or seat support frame are excluded from the invention if they do not tilt, with respect to vertical, a vertical or generally vertical, rotatatable, support that is part of, or movably, including pivotaly, attached to, a vertical or generally vertical, rotatable lower support located beneath a seat support plate or seat support frame.

Herein, when a range of number values is disclosed it is to be understood by those of ordinary skill in the appropriate art(s) that each numerical value in between the upper limit and the lower limit of the range is also disclosed, to at least 0.01 of a full number. Thus in a range of 1 to 10, this includes 2.04 to 10, 3.06 to 8 or 8.50, and so on. The addition of a new limitation in a claim previously stating from 2 to 7 changing it to from 3-7 or 4-6 would not introduce new matter whether those new ranges were specifically disclosed in the specification or not because of this explanation of the meaning of a disclosed broader range, such as 1-10. This meaning of a range is in keeping with the requirement in 35 USC 112 that the disclosure be concise. Also, the words decline and declining means the opposite direction of reclining and can go beyond just returning to a neutral position, e.g. declining the chair such that the chair seat slopes downward somewhat to make it easier for a person sitting in the chair to exit the chair.

Further, when the word "about" is used herein it is meant that the amount or condition it modifies can vary some beyond that stated so long as the advantages of the invention are realized and the concept of the invention is maintained. Practically, there is rarely the time or resources available to very precisely determine the exact limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

BRIEF DESCRIPTION OF DRAWINGS

FIG. 2 F is a vertical cross section of a side view of a modified ball joint pivot joint usable in the invention.

FIG. 2 K is a partial side view of another embodiment of the invention having a different tilting mechanism for reclining in which the support can be in one piece.

DETAILED DESCRIPTION

Regarding the figures, it is to be understood that like components are often labeled with like or similar numerals throughout the different figures. Unless otherwise specified, the components described herein about the present invention can be formed, made, covered, etc. from any suitable material and by any suitable manufacturing method. The various parts can be formed from steel, other metals including aluminum, wood, plastics including reinforced and glass-filled nylon or other moldable, stampable, weldable, or other shapeable materials and other structural materials unless otherwise noted. Also, when a frame, pipe, rod, base and lever is mentioned, the shape or size is not critical within reasonable limits so long as the described function is met, unless specifically stated otherwise.

Figure 1:
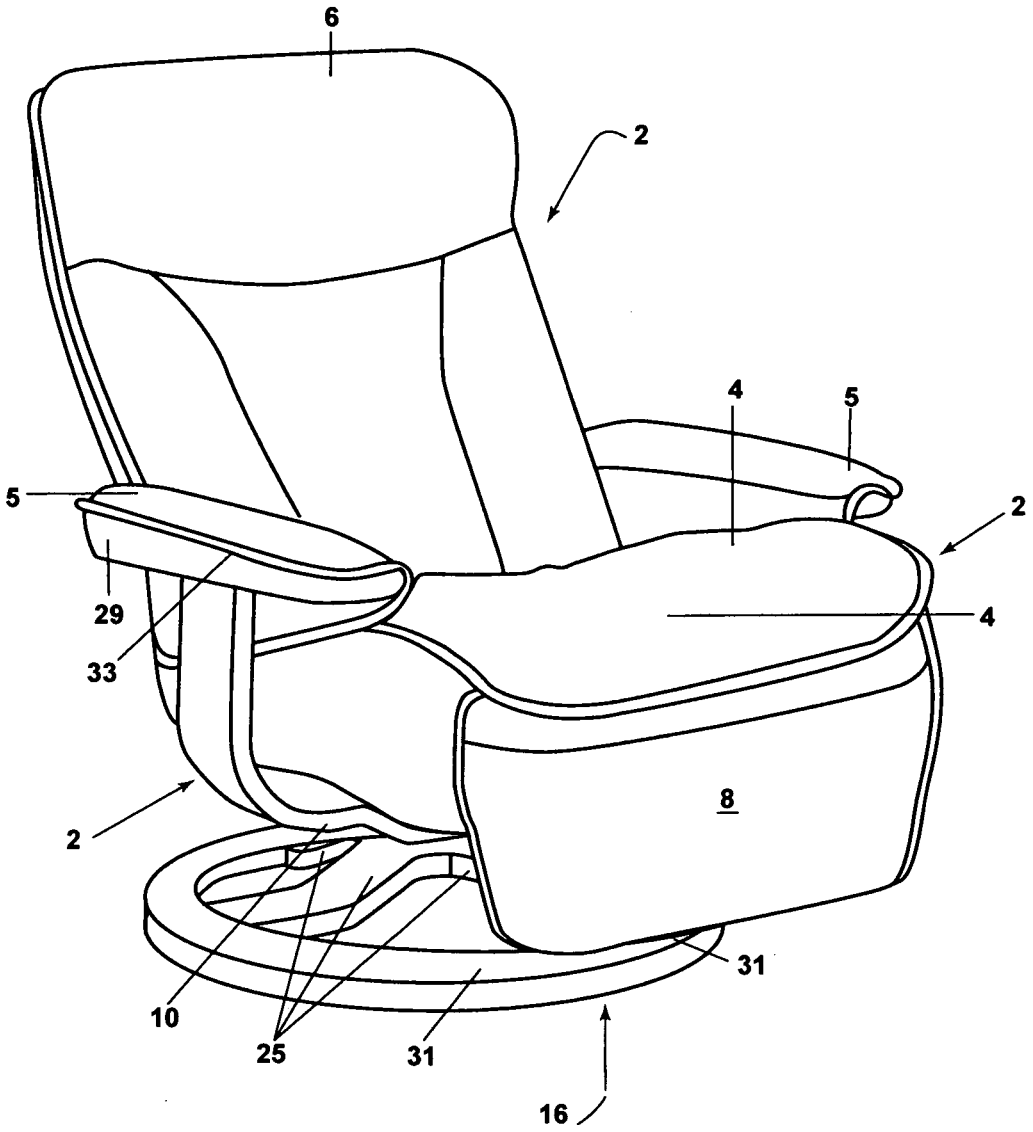
FIG. 1 is a perspective view a recliner chair of the invention.

The invention is a different type of recliner chair, preferably one that is also rotatable, i.e. that swivels, and that incorporates novel features for reclining, and optionally declining and for raising and lowering an optional leg rest and/or footrest. One embodiment of the invention is shown in perspective in FIG. 1 as a rotatable or swiveling recliner chair 2 comprising a seat 4, a backrest 6, an optional leg rest and/or footrest 8 connected to a conventional hinge or conventional pivot member (not shown in this figure) and one or two optional armrests 5. The recliner chair 2 is supported by a plate or frame 10, which in turn is connected to a rotatable support (not shown in this figure) that is supported by a base 16, in this embodiment comprised of a cross shaped member 25 attached to a horizontal ring shaped member 31. In this embodiment the plate or frame 10 also supports the optional armrests 5. One or more optional compartments 29, of various sizes and shapes, can be present below the armrests 5 and accessed by raising one side of the armrest 5 opposite a hinged side 33 (the hinge not shown in this figure).

Figure 1A:
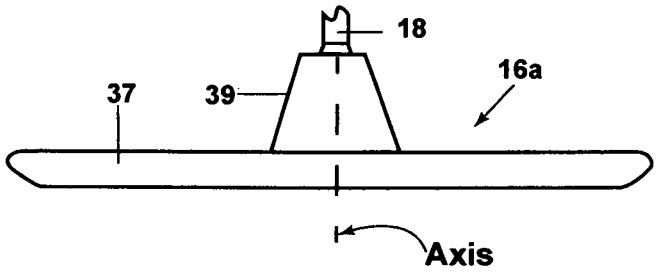
FIG. 1A is a front view of an optional base and a partial view of a lower support for the recliner chair shown in FIG. 1.
Figure 1B:
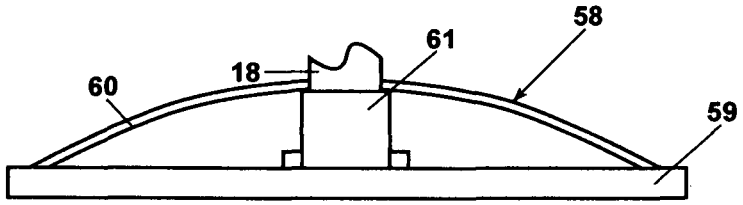
FIG. 1B is a front view of another optional base and a partial view of a lower support for the recliner chair shown in FIG. 1.

The base 16 can be of many shapes and configurations as will be obvious so long as it supports a support for a frame or seat plate supporting the seat of the recliner chair. Preferably, the base is of a shape and construction that shields the floor below the base from dust, etc. thus avoiding having to move the chair to vacuum underneath frequently. One suitable base 16A is shown in FIG. 1A in which a base member 37, preferably with no openings in its top for dust, etc. to fall through, supporting or containing a support 39 for holding a solid, hollow or partially hollow lower support 18 with a conventional bearing assembly (not shown) such that the lower support 18 can rotate, swivel. Preferably the support 39 has no openings to permit dust to enter and is attached to the base member 37 in any suitable manner to hold the support 39 in a secure manner, such as with a flange and screws or bolts, so that it does not move on the base member 37. FIG. 1B shows a vertical cross section of another suitable base 58 for the recliner chair 2 comprising a ring or solid circular member 59 partially or totally covered with a hemispherical section 60. A solid member 59 adds weight to the recliner chair 2, but also spreads the weight of an occupied recliner chair 2 better on a carpet being less likely to leave unsightly compression marks on the carpet than if a ring shaped member 59 is used. A conventional bearing assembly 61 supports the lower support 18 in a rotational or swiveling manner. The base does not have to be round, but can be of many shapes including a square, oval, rectangle, trapezoid, parallelogram and any other reasonable shape and construction as is obvious.

Figure 2A:
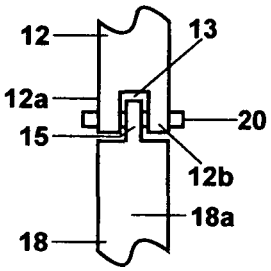
FIG. 2A is a partial front view of a support for the chair showing a pivot or hinged support joint used in the recliner chair invention.
Figure 2B:
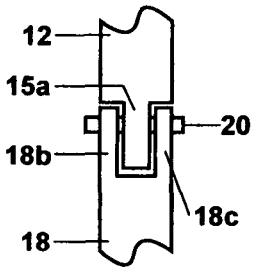
FIG. 2B is a partial front view of a support for the chair showing a modification of the pivot, hinge joint support shown in FIG. 2.
Figure 2C:
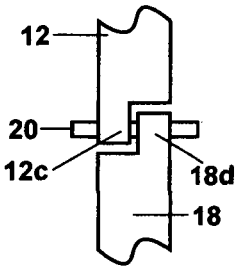
FIG. 2C is a partial front view of a different type of pivot, hinge joint support usable in the invention.
Figure 2D:
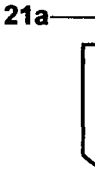
FIG. 2D is a partial side view of one component of the pivot, hinge joint in the support shown in FIGS. 2A and 2B.
Figure 2E:
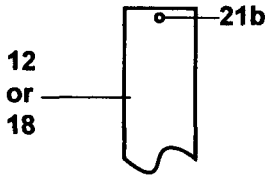
FIG. 2E is a partial side view of another component of the pivot, hinge joint in the support shown in FIGS. 2A and 2B.
Figure 2F:
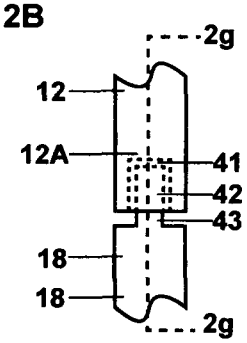
FIG. 2 is a partial side view of a recliner chair similar to that of FIG. 1 showing the lower support and power units for reclining and declining a chair seat plate and for raising and lowering a leg/footrest.
FIG. 2G is an exploded vertical cross section of a side view of another pivot joint usable as in the invention.
FIG. 2H is a side exploded side view of an upper support and lower support of another embodiment of a pivoting or tilting joint useful in the present invention.
FIG. 2J is a partial plan view of the top of the lower support shown in FIG. 2H showing a slot in its top end.
FIG. 2L is a partial front view of the embodiment of the invention shown in FIG. 2K having the tilting mechanism for reclining.
FIG. 2M is a partial side view of a portion of the support shown in FIG. 2K, and other embodiments, showing a different attachment of the tilting mechanism.
Figure 2G:
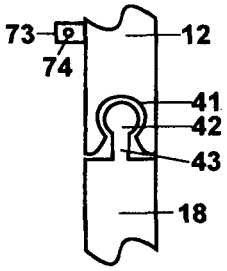
Figure 2:
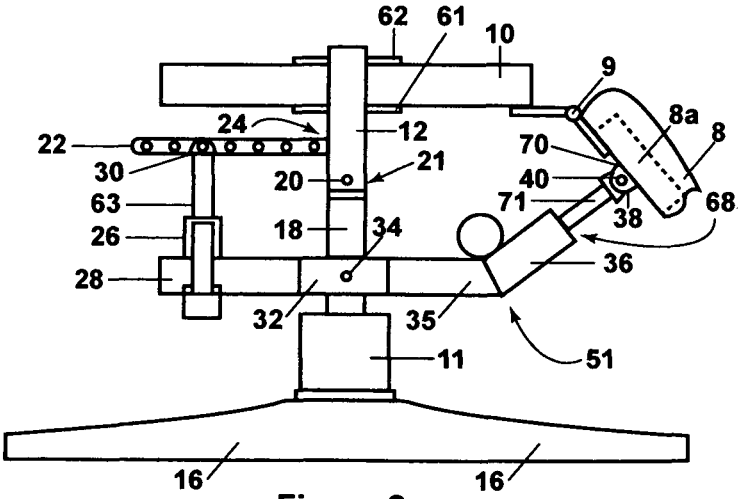

FIG. 2 is a partial side view, of a lower portion of the recliner chair 2 showing a chair support 12 and reclining mechanism assembly (described in detail later). This embodiment also has an optional leg/footrest 8 and a raising and lowering mechanism 51. A preferably rotatable upper support 12 is attached to a chair seat frame or plate 10 with a lower retainer ring 61 and an upper retainer ring 62 attached to the upper support 12 in any suitable manner so as to secure the chair seat frame, plate 10 to the upper support 12 in a fixed manner. On the lower end portion of the upper support 12 is a part of a pivot joint, hinge, etc. 21 that can be any of a plurality of pivot or joints including those shown in FIGS. 2A-2F. This joint 21, e.g. see FIG. 2B, allows the upper support 12 to move to different angles from vertical in at least two directions with respect to the lower support 18. The lower portion of the upper support 12 is attached to an upper end portion of a lower support 18, the upper end portion being a reciprocal part of the pivot joint 21 and held to the lower portion of the upper support 12, in this embodiment, with a pin 20. Connected in this manner, the upper support 12 can then pivot around the pin 20, tilt, in a plane to cause the chair seat frame 10, and a chair seat attached thereto, to recline and to decline. The lower support 18 is held by a conventional bearing assembly 11 mounted in the center of a base 16 thus permitting the lower support 18 and anything attached thereto, the upper support 12, including the pivot joint 21, anything attached to the upper support 12 including a lever 22 and the chair seat frame 10, to rotate or swivel around the base 16 at least 360 degrees clockwise and counterclockwise.

The reclining, and optionally declining, mechanism assembly mentioned above comprises a support 28 attached to a lower exposed portion of the lower support 18 a collar, clamp or holder 32 and one or more pins, bolts, or the like 34, a lever 22 attached in a fixed manner to the upper support 12, extending outward a desired distance in generally the same plane as the support 28 and a mechanism 26 supported by the support 28 and attached to the lever 22 with a pin, etc. 30 for pulling the lever 22 downward and pushing it upward. The mechanism 26 can be a manually powered, electrically powered or fluid drive device that causes the upper support 12 to tilt, pivot around the pin 20 and to return to a vertical or generally vertical position. In this embodiment the mechanism 26 is an electrically powered linear actuator 26 that pushes a rod 63 upward and pulls it back down to cause the chair frame or plate 10 to recline and return, and optionally to decline some to make it easier for a person to exit the chair 2. Preferably the lever 22 extends out from the upper support 12 a desired distance, preferably, but not necessarily, horizontally in the same plane that the upper support 12 pivots, tilts in. Lever 22 can extend out at any reasonable distance and angle from the upper support 12 so long as a point along the length of the lever 22, when lifted and lowered, causes the upper support 12 to pivot or tilt around the pin 20 in the plane mentioned. The collar, etc. 32 held fixedly by one or more pins or bolts 34 that enter holes or threaded holes in the lower support 18, or it can be welded or otherwise fixed to the lower support 18. A horizontal, or generally horizontal structural arm 28 extends outward from the collar 32, preferably some distance in the same plane in which the upper support 12 pivots. The movable component 63 (typically a rod) attached to the lever 22 any desired distance from the upper support 12 in any suitable manner such as with a clevis on the end of rod 63 and pin 30 in a known manner. The movable component 63 can alternatively be attached directly to the upper support 12 in a suitable manner, such as shown in FIG. 2M, a partial side vertical cross section view of the upper support 12 in which the upper support 12 has a recess 76 for a blade extension or clevis 30 of the movable component 63 having a hole therein for a pin 78 to lock it to the upper support 12 in a manner that the clevis 78 can rotate some on the pin 78.

It will be obvious to the skilled artisan that other known ways can be used for attaching a powered drive to the upper support 12 in an operable manner, and also that it is possible to orient a powered drive in an opposite manner such that a base of the powered drive attaches to the lever 22 or the upper support 12 and the movable component 63 attaches to the structural arm 28. The electrical wiring to operate one or more motors on the various types of electrically powered actuators, whether using gas or air pressure or mechanical devices like linear actuators, rack and pinion, and similar devices, can be largely hidden in grooves in the base, in structural members and in the padding as is known. Control switches or panel(s) for operating the electrical powered actuators can be on, in or outside one or both arm rests, but in a convenient location for the person sitting in the chair to operate.

The vertical support for the chair seat frame 10, in this embodiment the combination of the upper support 12 and/or the lower support 18, either include a pivot joint of some type or, combined in a single unit is a tilting member. Other embodiments, some of which are shown in FIGS. 2A-2H show this and other types of pivot joints or tilting supports. While the upper support 12 is rotatable, it does not rotate with respect to the plate or frame 10, but instead does rotate with the reclining chair 2, the plate or frame 10 and a lower support 18, all with respect to the base 16.

The pivot or hinge joint can be any kind of pivot joint, preferably a pivot joint that can pivot along a single vertical plane, some embodiments of which are shown in FIGS. 2A-2H. A preferred pivot joint is shown in FIGS. 2, 2A, 2B, 2D and 2E, the pivot joint shown in FIG. 2A comprising an upper support 12 having a U shaped slot 13 in its lower end portion forming two ears 12A and 12B as the uprights of the U, each ear having a hole 21 therethrough for receiving a pin or bolt 20 and a lower support 18, typically rotatable, having a lower portion 18A with a flanged or bladed upper portion 15, the flanged or bladed upper portion having a hole 21*a*, preferably a smooth hole, therethrough for receiving the pin or bolt 20 as shown in FIGS. 2A-C. FIG. 2E is a partial side view of either the upper support or the lower support containing the U shaped slot 13 used in the pivot joints of FIGS. 2 and 2A. Optionally, a space between the surfaces of the flange 15 and inside surfaces of the ears 12A and 12B can be filled, or nearly filled, with a slippery gasket, like a Teflon® gasket, or something similar, to make the pivot action smoother and/or less noisy or silent. Also, while the pin 20 can be made of any material having the necessary strength and stability for the purpose, it can be brass or similar non-binding material for the same purpose. FIG. 2B shows a pivot joint that is the reverse of the pivot joint of FIG. 2A and that is equally suitable. Where corners of the parts are shown as square it is to be understood that such corners can be radius shaped, angled or any other shape so long as the function of the pivot joint is not destroyed. Since these parts can show below the chair seat, at least at times, they can be stainless steel, chrome plated, anodized, or painted to be more attractive and easy to dust.

Other pivoting joints can be used, such as that shown in FIG. 2C wherein the upper support 12 can have an ear 12*c* as its lower portion (can be on the opposite side of that shown instead) and the lower support 18 having an ear 18*b* as an upper portion (can be on the opposite side of that shown instead). Each ear has a hole 21 therethrough for receiving the pin or bolt 20. Again, any space between the ears 12*c* and 18*b* can optionally contain a slippery gasket, like a Teflon® gasket, or something similar, to make the pivot action smoother and/or less noisy or silent.

FIGS. 2F and 2G show other embodiments that can use conventional ball joints, but preferably use types of modified ball joints for the pivoting joint as shown in these figures. In the embodiment shown in FIGS. 2F and 2G, a modified ball joint comprises a cavity 41 in the lower portion of the upper support 12, being slightly larger than the outer diameter of a flat sided ball shape 42 (see FIG. 2G, a vertical cross section through 2*g*-2*g* of FIG. 2F) having a neck 43, preferably integral with the flat sided ball shape 42 and the upper part of the lower support 18. A bracket 73 is attached to the upper support 12, having a hole 74 therethrough, for connection to a reclining drive as shown in other figures. While in FIGS. 2F and 2G the cavity 41 is in a lower portion of the upper support 12 and the flat shaped ball 42 of the ball joint is an upper portion of the of the lower support 18, the neck 43 being between the flat shaped ball 42 and the lower support 18, normally integrated with both, an opposite configuration, i.e. with the neck 43 and flat shaped ball 42 being on the lower end portion of the upper support 12 and the cavity 41 being in the upper portion of the lower support 18 is also usable as a pivot joint in the invention. In either embodiment a layer of a slippery material can be fixed in the ball joint as conventional and in between the flat shaped ball 42 and the cavity 41 to provide for a smoother and quieter movement of the ball 42 in the cavity 41. Any similar ball joint, or modified ball joint having sufficient range of motion is usable in the invention, given the disclosure herein.

Figure 2H:
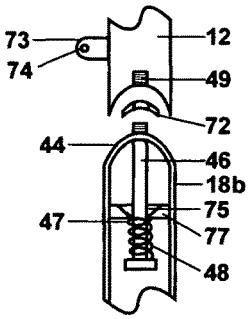
Figure 2J:
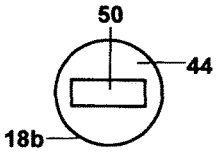

Another type of pivot joint usable in the invention is shown in FIGS. 2H and 2J. In this type of pivot joint an upper semi-spherical or arched face 44 of a hollow or partially hollow lower support 18 is curved and a lower face 45 of the upper support 12 is concave having a similar curvature to nest the upper face 44, optionally with a slippery material like grease or a slippery washer 72 therebetween, the lower end portion of the upper support 12 having a threaded hole 49 in its center. Preferably, the lower portion of the upper support 12 having a concave end 45 has a significantly smaller outside diameter than the outside diameter of the upper end of the lower support 18, but this is not necessary. A slot 50 in the curved or semi-spherical face 45 provides an opening in the upper face 44 as a guide for a bolt 46, having a threaded end portion, that extends through a tapered hole 75 in an intermediate plate 77 inside the hollow or partially hollow lower support 18 and through the slot 50 to be screwed into the threaded hole 49 in the upper support 12. A strong spring 48 is compressed against a washer 47 and the intermediate plate 77, the slot 50 guiding the bolt 46, to keep the upper support 12 in place on the lower support 18 as the upper support 12 is pivoted on the lower support 18 to cause the chair to recline and decline. The diameter of the bolt 46 should be just slightly smaller than the width of the slot 50 and can be coated with Teflon® or made of brass or another slippery material to permit easy and quiet action as it moves along the slot 50 (See FIG. 2J). Also, as before, a layer of a slippery material can be fixed between the semi-spherical surface 44 and the concave surface 45 to provide for a smoother and quieter movement of the semi-spherical surface 44 in the concave surface 45. As with other pivot joints, this type of pivot joint can be reversed by having the curved surface 44 and slot 50 on the end of the lower support 18 and the intermediate plate 77 and bolt 46 in a hollow or partially hollow upper support 12.

Referring to FIG. 2 again, an extension or support 35 is attached to, or part of support 28 and collar, etc. 32, preferably in the same plane as support 28, supports an optional second mechanism 68, in this embodiment another electrically powered linear actuator 36 that extends and withdraws a rod 71 attached, with an extension 38 having a hole therethrough, to a bracket 70 with a pin 40 such that the rod, as it extends from or withdraws into the actuator 36 can raise or lower a plate 8*a* attached with a hinge 9 to the chair frame or plate 10 and covered with a padded leg/foot rest 8, the linear actuator 36 controlled by the user in the same manner as the linear actuator 26.

While not shown here, the backrest 6 of the chair 2 can optionally also rotate at its lower end to recline independently of the chair seat 4 as will be shown later.

Figure 2K:
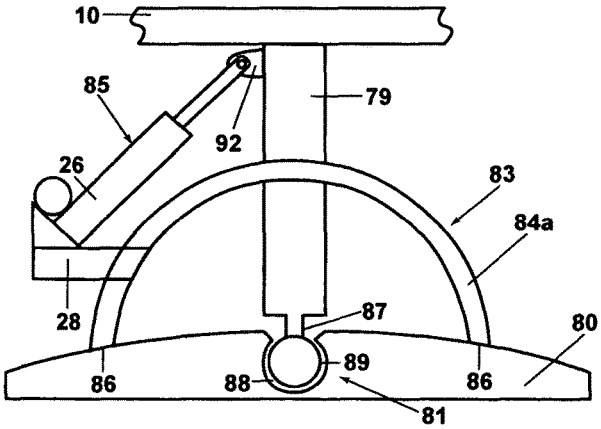
Figure 2M:
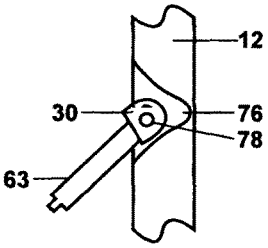
Figure 2L:
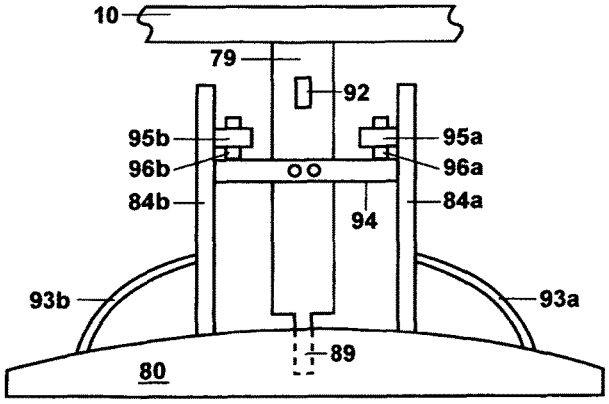

Another reclining mechanism suitable for a recliner that does not rotate or swivel but nevertheless tilts the support for the chair is shown in FIGS. 2K and 2L. As seen in FIG. 2K, a side view of the reclining/declining mechanism, this embodiment comprises a chair seat plate or frame 10, a different embodiment of a support 79 for the chair plate or frame 10, a support 79 whose longitudinal axis is vertical or generally vertical, but a support able to be tilted from up to about 55 degrees from vertical for reclining, tilted back to vertical and then, when desired, on up to about 10 degrees from vertical in the other direction for declining the chair seat for exit from the chair. This mechanism tilts by having a ball joint or modified type of ball joint 81 (see FIGS. 2F, 2G and 2M) on the lower end portion of the generally vertical support 79, i.e. a neck 87 joined to a ball or flat ball shaped member 88 in a cavity 89 mounted in a top center of a base 80, this joint 81 allowing the generally vertical support 79 to tilt in the range given above. An optional slippery layer of material like Teflon®, graphite or the like can fill space 88 to render the sliding of the ball, etc. 89 for tilting smooth and quiet. A frame 83 is comprised of two arched members 84*a* and 84*b* parallel to one another, each arched member 84*a* and 84*b* on either side of, and spaced from, the generally vertical support 79 (see FIG. 2L, a partial front view of the mechanism of FIG. 2K), is attached to a base 80 at their ends 86. Also a part of the frame 83, a frame extension 28, preferably horizontal, provides support for a tilt causing drive 85 comprised in this embodiment of a electrically powered linear actuator 26 that extends and withdraws a rod that is also attached to the generally vertical support 79, preferably with a bracket 92 and a pin as previously shown. The tilting drive 85 can be any manual, electrical or fluid drive having the power range of movement required for the range of tilt described above. Other types of drives capable of the same or similar movement and force in both directions would also be suitable.

FIG. 2L, a partial rear view of the embodiment shown in FIG. 2K, shows the base 80, the generally vertical support 79 with the bracket 92 attached to the chair seat frame or plate 10 (the tilt causing drive 85 is not shown in this figure), the curved frame members Ma and Mb with optional stabilizing supports 93*a* and 93*b* and a cross member 94 attached to the chair support 79 and running across between 93*a* and 93*b* with clearance between its ends and the curved frame members 84*a* and Mb (not shown in FIG. 2K). These curved frame members 84*a* and 84*b* provide guide surfaces for the wheels 95*a* and 95*b*, turning on axles 96*a* and 96*b* respectively, to maintain the support 79 in the same or generally the same plane as it is tilted from the vertical.

Figures 3, 3A, 3B:
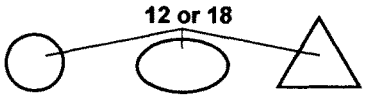
FIGS. 3-3F show various typical cross-sectional shapes of a vertical or generally vertical support useful in the invention.
Figures 3C, 3D:
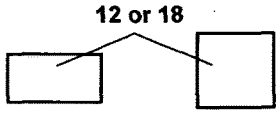
Figures 3E, 3F:
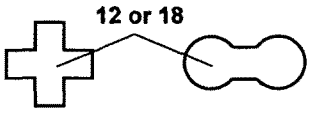

FIG. 2M shows just one of several alternative ways to connect a push/pull member 63 to a chair support 79 or upper chair support 12 and 158. Here a recess 76 is machined or formed in the upper chair support 12 to narrow the recessed portion such that after a hole 78 is drilled, formed in the narrow recess, a clevis 30 can be attached with a pin (not shown) in a known manner. The cross sectional shape of the upper chair support 12 and 158 and/or an upper portion and/or all of the lower support 18 and 157 and support 79 can be of most any shape so long as the working ends (the upper portion of the upper support and the lower portion of the lower support) of the upper support 12 and lower support 18 and/or the pivot, hinge joints function as shown and/or described herein. Some of the more typical shapes are shown in FIGS. 3-3 F. FIG. 3 shows a round cross section, FIG. 3A shows an oval cross section, FIG. 3B shows a triangular cross section, FIG. 3C shows a rectangular cross section, FIG. 3D shows a square cross section, FIG. 3E shows a cross as a cross section and FIG. 3F shows an hour-glass shape as a cross section. The working ends of the supports having these cross sections, preferably except for a round cross section for the lower working end of the lower support, can be shaped differently, or have, an added end portion, to form the types of pivot joints shown in FIGS. 2-2K and doing so is within the ordinary skill of the art. While not necessary, it is preferable that the lower support 18 be able to rotate or swivel with respect to the base.

Figure 4:
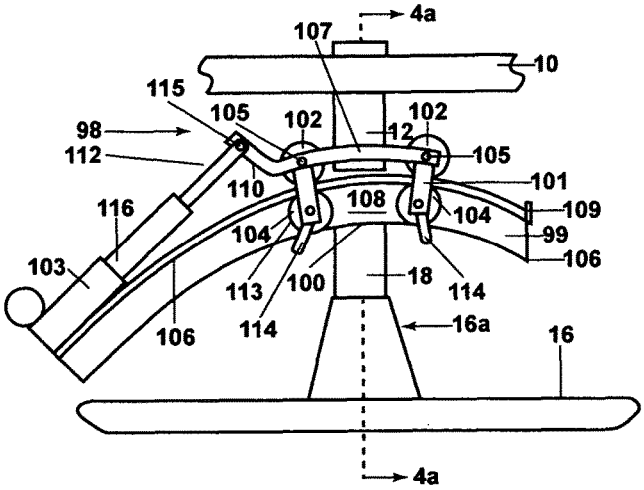
FIG. 4 is a partial side view of a still different type of upper vertical support tilting mechanism usable in the invention.
Figure 4A:
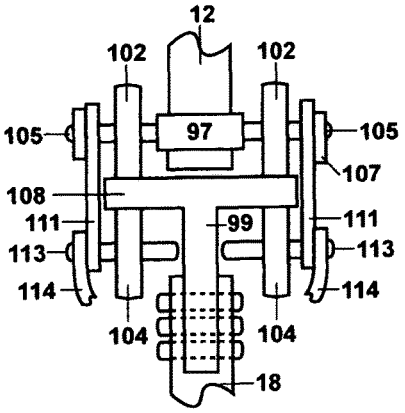
FIG. 4A is a partial vertical cross section 4A-4A of the mechanism shown in FIG. 4.

Another mechanism for tilting the seat frame/plate support to recline or decline the chair is shown in a partial side view in FIG. 4. In this embodiment the upper support 12, fastened in a non-rotating manner at the top end to the seat or seat frame 10 and at its bottom end in a non-rotating manner to a platform 97 of a tilting mechanism 98 which in turn is supported by a rotating lower support 18 mounted in a rotatable manner in a conventional hub 16*a* mounted on the base 16. Preferably, the entire assembly from the seat or seat frame or plate 10 to the lower support 18 can be rotated or swiveled with respect to the base 16, but it need not be to be within the broadest scope of the invention. The tilting mechanism 98 comprises a curved, T shaped member 99 fastened to the top end of the lower support 18 by any suitable manner such as welding at the joint 100 or by pins or bolts as shown in FIG. 4A. The tilting mechanism 98 further comprises a set of 4 support wheels 102 and a set of 4 keeper wheels 104. The set of four support wheels 102, two wheels being spaced apart along the upper surface of each opposite side, and spaced apart sufficiently, on each side of the upper support 12 and the platform 97 on which it is mounted, to be able to turn without rubbing on the platform 97 or the upper support 12. The four support wheels 102 are typically parallel to each other, preferably two each in two separate vertical planes. All four of the support wheels 102 ride on the upper surface 101 of the curved T shaped member 99 as the wheels 102 turn to move the platform 97 to tilt the upper support 12 as they are moved back and forth on surface 101 by a linear drive 103 mounted to a rear portion of the curved T shaped member 99 and moves a push/pull member 112. Axles 105 running perpendicular to and above the upper surface 101 of the curved T shaped member join each pair of support wheels 102 in a known manner to allow the support wheels 102 to turn freely and to keep these wheels spaced apart properly to maintain their contacting surfaces remaining in the appropriate track on the upper surface 101. Side members 107, supported by axles 105 and spanning between them support the platform 97. A front end of the curved T shaped member 99 can have an optional safety stop 109, preferably on the upper surface 101, or it can be elsewhere on the curved T shaped member 99 to stop leading support wheels 102 or leading keeper wheels 104 from running off of the end of the curved T shaped member if something breaks.

Four keeper wheels 104, two sets of two spaced apart wheels 104, each keeper wheel 104 supported by an axle 113 and in contact with a lower surface 106 of the top part 108 of the T shaped member 99, each different pair of keeper wheels 104 being on an opposite side of the lower vertical member 99 of the curved T shaped member 99, being spaced sufficiently, on each side of the vertical member 108 to be able to turn without rubbing on the vertical surfaces of 99 (see FIG. 4A). The four keeper wheels 104 are typically parallel to each other, preferably two each in two separate vertical planes. All four of the keeper wheels 104 are kept in place to ride on the lower surface 106 of the top portion of the curved T shaped member 99 by two keeper wheel supports 111 that join the top axles 105 to the lower axles 113, there being two of each of the axles 105, 113. As the wheels 102 turn to move the platform 97 back and forth along the curved T shaped member 99, the keeper wheels 104 also turn to keep the support wheels 102 in their proper place on the upper surface 101. Pair of two of the axles 113 on opposite sides of the vertical portion of the curved T shaped member 99 can be connected with a curved member 114 extending at such an angle from horizontal (FIG. 4) that the curved members 114 do not interfere with the lower chair support 18 to undesirably limit the amount of tilting. Such an arrangement will contain each pair of keeper wheels 104 in a known manner to allow the keeper wheels 104 to turn freely and to keep these wheels spaced apart properly to maintain their contacting surfaces remaining in the appropriate track on the lower surface 106. Optionally, one or more stabilizing members 114 can connect to an appropriate place on each one or both axles 113 and the keeper wheel support 111.

The drive 103, a part of the tilting mechanism 98, can be any of many types of drives, but preferably is a linear actuator drive either manually powered or driven by electricity or with a pressurized fluid. The drive 103 is preferably mounted on the rear end or end portion of the curved T shaped member 99 and has a push/pull member that is connected to the platform 97 indirectly via a rod 115 using a type of clevis 112 that spans the side members 107 and/or the keeper wheel supports 111 by any suitable means. In the embodiment shown in FIG. 4, a rod 115 spans between two side members 107, each being, in this embodiment, in contact with, or a part of, the keeper wheel support 111 closest to the drive 103. A push/pull extension 112 on the end of the moving push/pull part 116 of the drive 103 is attached in a known way to the rod 115 such that the clevis 112 can rotate around the rod 115 as necessary when the platform 97 is moved.

As the moving part 116 of the drive 103 is retracted it pulls the platform 97 along the upper surface 101 towards the rear of the T shaped member 99 tilting the upper support 12 in a way that causes the seat or seat frame 10 to recline and as the reverse motion is caused by reversing the drive 103 direction extending the moving part 116, it causes the upper support 12 to return to a normal sitting position and if continued causes the upper support 12 to tilt in the opposite direction causing the seat or seat frame 10 to decline for exiting the chair. The rear end of the drive 103 is positioned such that it clears a top of the base 16 or the floor by a practical distance. In the embodiment shown in FIG. 4 the rear end of the drive 103 has a slightly larger radius from the center of the base than the radius of the base 16, but this would not usually be necessary. Where it might appear to be, for best stability it would be better if the radius of the base 16 was almost, at least as great or greater than the above described radius of the rear end of the drive 103, or the base can be oval or generally oval, square, rectangular, or have 5 or more sides. The reclining mechanism 98 of FIGS. 4-4*b* will rotate with the lower support 18 and parts above.

Figure 4B:
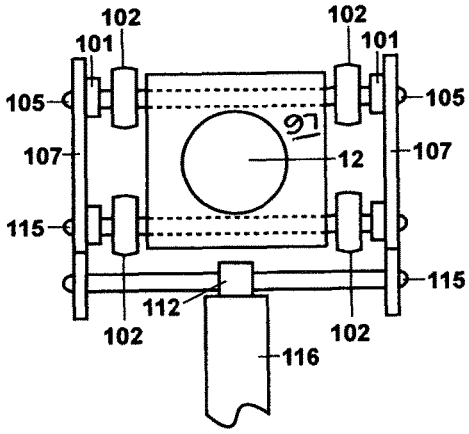
FIG. 4B is a partial plan view of the tilting mechanism shown in FIGS. 4 and 4A.

It will be obvious to a skilled artisan, given the disclosure above, that the concept for tilting the upper support 12 to decline and/or to recline the chair seat shown in FIGS. 4, 4A and 4B can be executed in other embodiments that are modifications of the embodiment illustrated. For example, one or more of the wheels can be replaced with skids, such as slippery skids, the curved T shaped member 99 can be replaced with different types of a box channel or one or more C shaped members, the shape of the curved member can be concave instead of convex as in FIG. 4, and many other configurations and assemblies while still keeping with the tilting mechanism concept shown here.

Any number of mechanisms can be used as the reclining/declining drive mechanisms 26 and also for the optional mechanism 36 to raise and lower the optional footrest/leg rest 8, and for any other similar mechanisms. Linear actuators, either powered electrically or manually powered can be used, some examples being those offered by Firgelli Technologies, Inc. of Victoria, BC, Canada, Northern Tool+ Equipment of Arnold or St. Peters, Mo., their Wel-Bilt Linear Actuators, and other similar linear actuators, manual types such as simple scissor jacks laid on their side with manual crank, rod and 90 degree turn or universal joint mechanism. Also suitable are rack and pinion drives, either motor powered or manual powered, the latter including the type used on a Swisstek®'s Hercules tripod, those offered as manual winches by the Haacon Group of D-97896 Freudenberg, Germany, and motor powered rack and pinion drives like those of Atlanta Drive Systems Inc. of 74321 Bietigheim-Bissingen, Germany, and equivalent systems. Also, motor powered fluid, preferably air, cylinders can be used like the NCY2 or 3 available from SMC Corporation of America located in Noblesville, Ind. Further, gas cylinders like those used on automobile hoods, rear lift doors and office chairs, like those offered by Office Replacement Parts.com of Kew Gardens, N.Y., can be used either with or without a spring assist, preferably coil spring assisted with the coil spring surrounding the gas cylinder, but many types of springs can be used as an assist as will be obvious to those of ordinary skill given the disclosure herein.

Figure 5:
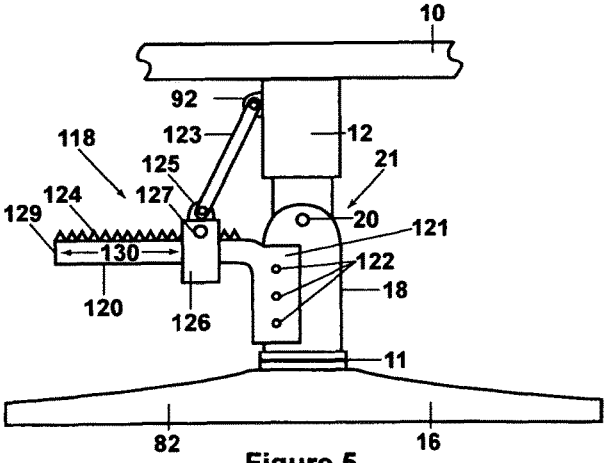
FIG. 5 is a partial side view of another embodiment of a manual reclining mechanism useful in the invention.
Figure 5A:
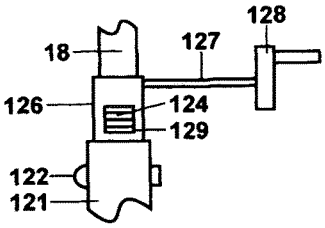
FIG. 5A is a partial rear view of the embodiment shown in FIG. 5 and showing more parts for manual operation.

Other types of manual powered with spring and/or one or more gas cylinders as assistance, or alone, can be used to decline and/or recline the chair. For example, FIG. 5 is a partial side view of a reclining and declining chair showing the manual mechanism and parts that cause it to decline and/or recline using a manually powered mechanism, but instead a plurality of parts that are biased to decline with reclining being caused by moving the force point on a modified U shaped spring, or optionally by shifting ones weight to the back of the chair seat and backrest. The embodiment of FIG. 5 can be like the embodiment in FIGS. 1 and 2 except here the optional leg rest and raising/lowering mechanism is not shown and the linear actuator 26 is replaced by a manually operated rack and pinion mechanism 118 comprising an optional leaf type or semi-U or L shaped spring 120 having a mounting bracket 121 bolted to a preferably rotatable lower vertical support 18 with bolts 122. A lower portion 82 of the base 16 is preferably a ring in plan view. The spring 120 can be a single leaf or two or more leaves arranged in a known manner to affect more or less resistance to bending to equip the mechanism for heavier duty if desired. One surface of the spring 120, any of the surfaces will do, contains a rack 124 portion of a rack and pinion mechanism, with a conventional pinion gear assembly 126 mounted on the spring 120 and rack 124. While this pinion can be powered by a motor, in this embodiment it is manually powered with a rod 127 extending from the pinion 126 a sufficient distance for mounting a wheel 128 (see FIG. 5A, a partial rear view showing the manual members of the pinion 126), such as what is known as a spinner wheel located in a convenient location for a person sitting in the chair to reach down and rotate the wheel 128. An arm 123 connects a pinion bracket 125 to a bracket 92 attached to the upper support 12 as described earlier. The location of the bracket 92 on the upper support 12 and the bracket 125 on the pinion 126, and the length of the connecting arm 123 can be changed to provide the desired leverage and ease of operation.

The location of the pinion 126 on the rack 124 and the optional spring 120 shown in FIG. 5 is in a neutral or normal sitting position. When a person sits down in the chair (not shown) and leans back, the upper support 12 can, if desired, pivot backward until the seat support plate 10 is about horizontal due to a slight bending of the optional spring 120, or the person can turn the wheel 128 in the appropriate direction to cause the seat support plate 10 to return to a normal sitting position from a declined position. By continuing to turn the wheel 128 in the same direction, the pinion 126 moves toward an end 129 of the spring 120 causing the pivot joint 21 to continue to pivot causing a reclining of the seat support plate 10 and the chair (not shown). Additional degrees of recline is optionally obtained with a bending down of the optional spring 120. Turning the wheel 128 counterclockwise or counterclockwise results in moving the pinion mechanism along the rack 124 as shown by 130 to reach the desired degree of reclined, neutral and declined positions. To return to a normal sitting position, or to a declined position, the person sitting in the chair turns the wheel in an opposite direction and finally leans forward to exit and or further decline the chair seat.

As will be apparent to one of ordinary skill in this art, many modifications to the structure of the reclining/declining mechanism 118 can be made while still falling within the scope of this invention, i.e. any mechanism that causes the upper support 12 or an upper support 79 to tilt torecline or decline the chair 2. For example, instead of using a rack and pinion drive, with or without a spring of some type, to cause such tilting, the arm 123 could be connected to a gas cylinder of appropriate resistance, with or without a coil spring booster, to replace the mechanism 118, along with many other arrangements.

Figure 6:
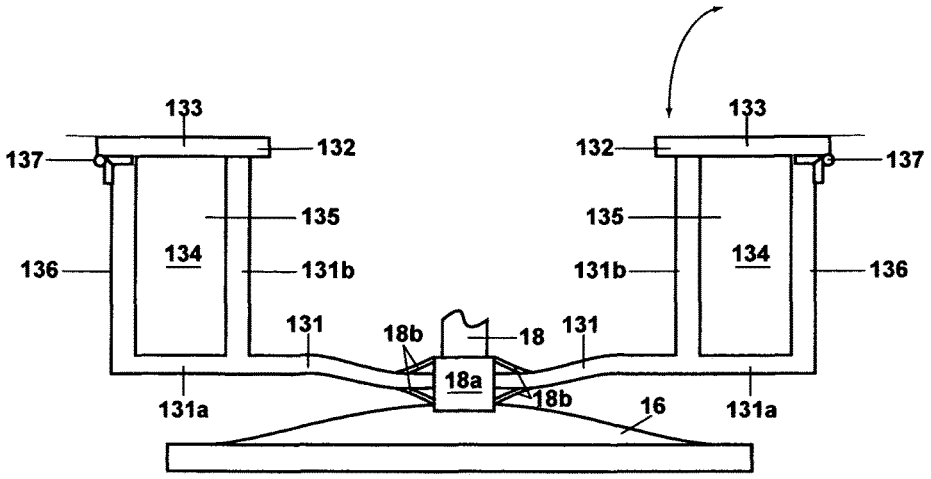
FIG. 6 is a partial front view showing some optional hinged armrests and storage compartment features of the invention.

FIG. 6 shows a front view of an optional type of armrest with an optional storage feature usable on any of the embodiments of the invention. In this embodiment the optional feature comprises an armrest support 131 attached to a mount 18*a* attached on the lower vertical support 18 so that the armrest support rotates as the lower vertical support 18 and the mount 18*a* rotates. Optional additional supports 18*b* for the armrest supports 131 can be provided attached to the mount 18*a* and to each support 131, both above and below each armrest support 131 if desired, to provide additional support. Each armrest support 131 has a generally horizontal portion 131*a* and a vertical portion 131*b*. An upper end of each vertical portion 131*b* acts as a rest or support for a lifting end 132 of armrest 133. A further optional feature is one or two storage compartments 135, supported by the arm rests support 131, 131*a* and each storage compartment 135 having an outer side 136, an optional front panel 134 and an optional back panel (not shown). The arm rest 133, in this embodiment, is hinged on the outside with hinge 137 to permit the arm rests 133 to be pivoted upward away from the person sitting in the chair to gain access to the storage compartment 135. Of course, the arm rests 133 are usually padded and upholstered in various ways and the storage compartments decorated as desired With this optional feature the arm rests rotate with the chair, but do not recline or decline, remaining in a generally horizontal position. But, they can be reclined and declined with the chair by attaching the armrest support 131 to the chair seat frame or plate 10, or to the upper portion of the upper vertical support 12 if desired. The optional storage compartment(s) 135 can contain a pivoting tray like used on passenger planes, particularly in first class, newspapers, magazines, laptop, tablet, books and other things that one sitting in the chair might desire to have handy. The armrest(s) 133 and/or the outer side(s) 136 of the compartment(s) 135 can also support cup holders, a control panel for the linear activators on the chair, holder(s) for remote controls for the linear activators on the chair, for entertainment components, pens and pencils and other useful items.

Figure 7:
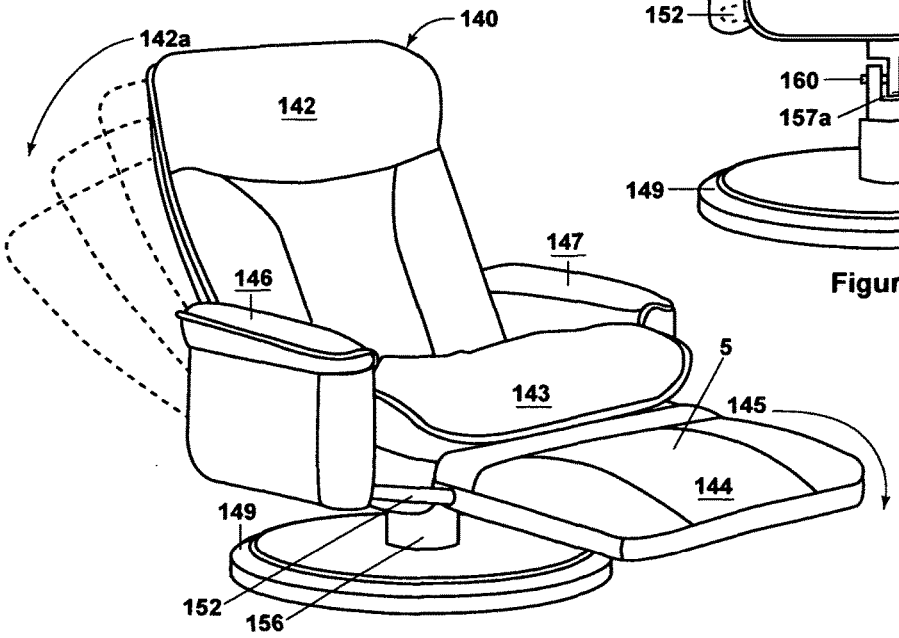
FIG. 7 is a perspective view of a reclining chair of the invention having an optional backrest reclining feature and a optional raising and lowering leg/foot rest.

FIG. 7 is a perspective view of another preferred embodiment of the present invention showing a rotating and reclining chair 140, optionally also declining, according to the invention, comprising a backrest 142, preferably a reclining backrest as shown in 142*a*, a seat 143, an optional leg and/or foot rest 144 supported in its top portion with axle like supports 152 and 154
(FIG. 8*a*)) so the leg and/or foot rest 144 can be raised and lowered to various desired positions, a generally vertical support 156 housing a rotatable, pivoting, generally vertical, support 157,158 (see FIG. 8) for a chair seat frame or plate (not shown) that allows the chair 140 to rotate generally horizontally in both clockwise and counterclockwise directions, and a round, oval or racetrack shaped base 149 supporting the vertical support 156. The armrests 146,147 on the chair 140 can be of any type, but preferably are like or similar to the armrest 133 with compartments 135 as shown in FIG. 6.

Figure 8:
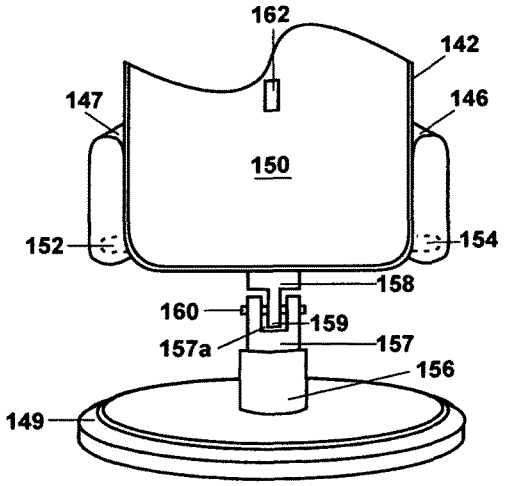
FIG. 8 is a partial rear view of the chair of FIG. 7.
Figure 8A:
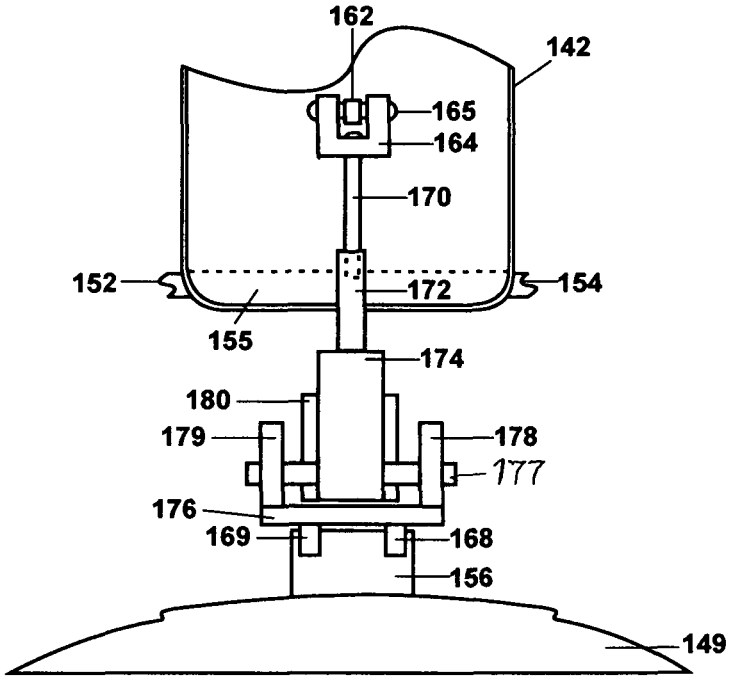
FIG. 8A is a more detailed partial rear view of the chair of FIG. 7.
Figure 9:
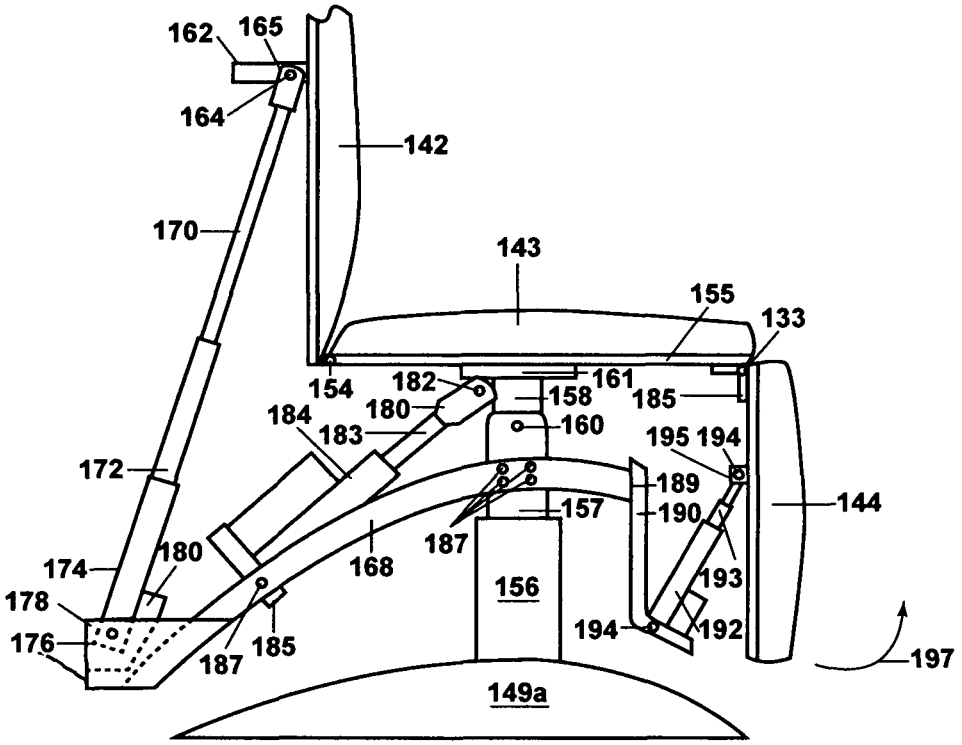
FIG. 9 is a partial side view of the chair of FIG. 7 showing a still different reclining mechanism and the optional mechanisms used to move the backrest and the leg/foot rest.

FIG. 8 is a partial rear view of the reclining, rotating chair 140 shown in FIG. 7 showing a lower portion 150 of the back of the backrest 142, supported at or near its lower end with one or two axle portions 152,154 that are attached to a backrest plate (covered by the upholstery) and on the ends of the axle(s) 152, (154) by sockets (not shown) mounted in lower side portions of the armrest supports or sides of the armrest compartments 146, 147 allowing the backrest 142 to recline and decline as shown by the dashed lines at 142*a*. The backrest plate is not shown in this FIG. 8 because it is covered with an optional covering of cloth, leather, vinyl or other upholstery material. Mounted to the backrest plate is a linking member 162, preferably having a hole therethrough, for connecting a clevis 164, or any suitable connecting means, with a pin 165 (see FIG. 8A), or some other known linking device. Mechanisms for reclining and declining the chair seat 143, the backrest 142 and the leg/footrest 144 are not shown in this figure for simplicity, but are shown in FIGS. 8A and 9. The round or oval base 149 supports a housing containing bearings (not shown) to hole a lower vertical or generally vertical shaft 157, having a cut out 157*a* on its upper end to receive an extension piece 159 of an upper support shaft 158 attached at its top end to either an optional plate 161 attached the seat frame or plate (see 155 in FIG. 9) of the chair 140, or the top end of the upper support shaft 158 can be attached directly to the seat frame or plate 155 without using the optional plate 161. The housing 156 supports the shaft 157 in a manner that the shaft 157 can freely rotate clockwise and counter clockwise in a known manner. The upper part of the lower shaft 157 and the extension piece 159 of the upper support shaft have aligning holes therethrough for a pin or bolt 160 permitting the upper support shaft 158 to pivot to recline/decline the chair 140 according to the invention (see FIG. 9).

FIG. 8A is a partial rear view of the chair 140 showing an optional mechanism for reclining and declining, and/or returning, the backrest 142 of the chair 140. The word declining means the opposite direction of reclining and can go beyond just returning to a neutral position, e.g. declining the chair to a down sloping angle to make it easier for a person sitting in the chair to exit the chair. A frame or plate (not shown) supporting the chair backrest 142 includes in this embodiment a bracket or connector 162 protruding out the back of the covering to connect to a clevis 164 or other connecting means with a pin or bolt 165 attached to a rod extension 170. The bracket or connector 162 can be of various lengths including shorter than shown, or can be eliminated by attaching the clevis 165, etc. directly to a recess in the backrest support plate or frame in a known manner. An extension rod 170 is connected by any suitable manner to a push/pull rod 172 of a linear actuator 174 and electrical drive 180, or any suitable manual or driven push/pull mechanism. The linear actuator 174 is supported by spaced apart supports 178,179, supported by a plate 176 fixedly resting on the spaced apart curved supports 168,169, in a pivoting manner with an axle, rod, bolt or pin 177, attached to spaced apart curved supports 168,169 (shown in FIG. 9 and described below). This backrest reclining/declining mechanism just described can be manipulated by a person in the chair, or out, to cause the backrest 142 to pivot around its lower supports 152,154 to a desired angle. This reclining/declining mechanism just described can be used on a rotating, or non-rotating chair, but here is shown on a rotating chair with a rotating vertical or near vertical support 157 (FIG. 9) rotationally supported in a holder 156 mounted in or on a base 149.

FIG. 9 is a partial side view of the chair 140 of FIGS. 7-8A with the armrests and optional compartments below the armrests not shown. Several of the items described above in description of FIG. 8A will not be repeated here as they are readily understandable from above. The spaced apart curved supports 168,169 are attached to the lower portion 157 of the rotatable vertical or near vertical chair seat support, including the pivoting or hinging upper support portion 158, with pins, bolts 187 or with any suitable method of attachment in a known manner. The lower, back portion of the spaced apart curved supports 168,169, support the plate 176 in a fixed manner which in turn supports the spaced apart linear actuator 174 spaced apart supports 178,179. Closer to the rotating vertical or near vertical support 157 is mounted a plate 185 mounted to the spaced apart curved supports 168,169 using a pin, bolt, rod, etc. 187 such that it can rotate around the pin, etc. 187. The plate 185 supports a drive mechanism 184 that includes a movable push/pull rod 183 attached to a clevis 180 in turn attached to a lever (not shown) with a pin, bolt, rod, etc. 182, the lever attached to the pivoting or hinged upper support 158 connected to the lower portion of the vertical or near vertical support 158 with a pin, rod, bolt, etc. 160 permitting the upper support 158 to pivot or hinge to recline or decline the chair seat 143 support plate or frame 155. Optionally, but preferably, a front part of the curved supports 168,169 have integral, or attached at 189, another set of spaced apart supports 190, a lower portion of the spaced apart supports 190 supporting in a pivoting manner another drive mechanism, in this embodiment a linear actuator 192 having a push/pull rod 193 and optionally with a rod extension, the latter in this embodiment connected to a bracket 194 with a pin, bolt, rod, etc. 195. The bracket 194 is attached to the backside of a leg/foot rest 144 support plate or frame that is in turn attached in a pivoting or hinged manner with one plate of a two plate hinge 185, having a pin 133 connecting the two plates, the other plate attached to the chair seat plate or frame 155. This optional portion allows a person sitting in the chair to raise or lower the optional leg/foot rest 144 as shown at 197 to any desired angle for comfort and relaxation. In the embodiment shown in FIGS. 7-9, the reclining/declining, raising/lowering, etc. mechanisms for the backrest 142, chair seat 143 and leg/foot rest 144, and their various supports, all rotate with the rotation of the vertical support portion 157, but that is optional. It would be obvious to mount the spaced apart curved supports 168,169 to the holder 156, or to the base 149*a* in a manner such as shown in FIGS. 2K and 2L, or in any other manner made obvious by the disclosure herein. In this embodiment, the base 149*a* in plan view is oval with its longer axis being in the orientation that the chair seat 143 would likely be in most of the time it is in use, but other shape bases would also be suitable.

Different embodiments employing the concept and teachings of the invention will be apparent and obvious to those of ordinary skill in this art and these embodiments are likewise intended to be within the scope of the claims. As just one example, the curved supports 99, 106, 168,169 could be replaced with straight supports like shown in FIG. 2 or different straight or curved supports. Also, as another optional accessory for all the chairs, if desired a skirt, preferably circular, can be added below the chair seat or chair seat frame or plate and connected thereto and ending at or just above the base to hide the mechanisms and supports beneath the chair seat, etc. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A reclining and/or declining chair comprising a backrest, a chair seat frame or plate member supporting directly or indirectly a recliner chair seat for supporting a person sitting on the chair seat, the chair seat frame or plate supported by a vertical or generally vertical support member comprised of a lower portion and an upper portion extending below the chair seat frame or plate, the lower portion being longer in length than the upper portion extending below the chair seat frame or plate, a mechanism for changing the angle that at least the upper portion of the vertical or generally vertical support member extending below the chair seat frame or plate makes with respect to vertical to cause a reclining and/or declining of the chair seat frame or plate, wherein said upper portion is joined to said lower portion in a pivoting manner with a hinged joint to allow the changing of said angle from vertical, a base for supporting the chair and for supporting a holder for the vertical or generally vertical support member, said mechanism being operable by a person sitting in and using the reclining and/or declining chair to provide the desired degree of recline or decline of the chair seat.

2. The chair of claim 1 wherein the vertical or generally vertical support member is rotatable to allow the chair to rotate with respect to the base.

3. The chair of claim 2 wherein the upper portion of the vertical or generally vertical support member is hinged to the lower portion with a hinge comprising a pin or a bolt or a modified ball joint allowing the upper portion to tilt with respect to the lower portion to cause the reclining and/or declining of the chair.

4. The chair of claim 2 further comprising one or more additional mechanisms for raising a leg/footrest connected to the chair and/or for reclining and returning a backrest.

5. The chair of claim 3 further comprising one or more additional mechanisms for raising a leg/footrest connected to the chair and/or for reclining and returning a backrest.

6. The chair of claim 5 further comprising one or two hinged arm rest(s) with a compartment below the arm rest for magazines and/or books and/or newspapers.

7. The chair of claim 3 wherein the mechanism further comprises an electric drive to cause the changing of said angle.

8. A reclining and/or declining chair comprising a backrest, a chair seat frame or plate member supporting directly or indirectly a seat for supporting a person sitting on the seat, the chair seat frame or plate supported by a rotating vertical or generally vertical support member extending below the chair seat frame or plate and having an upper portion extending below the chair seat frame or plate and a lower portion, a mechanism for changing the angle that at least the upper portion of the vertical or generally vertical support member makes with respect to vertical to cause a reclining and/or declining of the chair seat frame or plate, and a base for supporting the chair, said upper portion extending below the chair seat frame or plate having a length shorter than the length of the lower portion, said vertical or generally vertical support member having a member on the upper portion that said mechanism attaches to for reclining and/or declining the chair, the two portions of the vertical or generally vertical support being joined in a pivoting manner with a hinge comprising a pin or a bolt or a modified ball joint, said mechanism being operable by a person sitting in and using the reclining and/or declining chair to provide the desired degree of recline or decline of the chair seat.

9. The chair of claim 8 wherein the mechanism further comprises an electric drive to cause the changing of said angle, reclining, declining or returning of the chair seat.

10. The chair of claim 8 wherein the chair further comprises a leg rest that raises and lowers by a mechanism that is electrically driven.

11. The chair of claim 10 further comprising one or more additional mechanisms for reclining and returning a backrest.

12. The chair of claim 8 further comprising one or more additional mechanisms for raising a leg/footrest connected to the chair and/or for reclining and returning a backrest.

13. The chair of claim 12 further comprising one or two hinged arm rest(s) with a compartment below the arm rest for magazines and/or books and/or newspapers.

* * * * *